US010513805B2

(12) United States Patent
Wang et al.

(10) Patent No.: US 10,513,805 B2
(45) Date of Patent: Dec. 24, 2019

(54) SPIKE RESISTANT PACKAGE AND ARTICLE

(71) Applicant: Milliken & Company, Spartanburg, SC (US)

(72) Inventors: Yunzhang Wang, Duncan, SC (US); Heather J. Hayes, Chesnee, SC (US)

(73) Assignee: Milliken & Company, Spartanburg, SC (US)

( * ) Notice: Subject to any disclaimer, the term of this patent is extended or adjusted under 35 U.S.C. 154(b) by 291 days.

(21) Appl. No.: 15/671,884

(22) Filed: Aug. 8, 2017

(65) Prior Publication Data

US 2019/0048496 A1 Feb. 14, 2019

(51) Int. Cl.

| | |
|---|---|
| ***D03D 1/00*** | (2006.01) |
| ***D03D 13/00*** | (2006.01) |
| ***D03D 15/00*** | (2006.01) |
| ***A41B 1/08*** | (2006.01) |
| ***A41D 1/04*** | (2006.01) |

(Continued)

(52) U.S. Cl.

CPC ..... *D03D 1/0041* (2013.01); *A41B 1/08* (2013.01); *A41D 1/04* (2013.01); *A41D 1/06* (2013.01); *A41D 3/00* (2013.01); *A41D 31/245* (2019.02); *A43B 7/32* (2013.01); *D03D 13/008* (2013.01); *D03D 15/00* (2013.01); *F41H 1/02* (2013.01); *F41H 1/04* (2013.01); *F41H 5/0485* (2013.01)

(58) Field of Classification Search

CPC ..... D03D 1/0041
USPC ..... 428/680
See application file for complete search history.

(56) References Cited

U.S. PATENT DOCUMENTS

| | | | |
|---|---|---|---|
| 1,213,118 | A | 1/1917 | Lynch |
| 3,563,836 | A | 2/1971 | Dunbar |

(Continued)

FOREIGN PATENT DOCUMENTS

| | | |
|---|---|---|
| GB | 1 577 012 | 10/1973 |
| GB | 2 242 193 | 9/1991 |

(Continued)

OTHER PUBLICATIONS

Patent Cooperation Treaty PCT International Search Report. dated Oct. 4, 2018. International Application No. PCT/US2018/043951. International Filing Date: Jul. 26, 2018.

(Continued)

*Primary Examiner* — Brent T O'Hern
(74) *Attorney, Agent, or Firm* — Cheryl Brickey

(57) ABSTRACT

A spike resistant package containing a pouch, a first grouping of spike resistant textile layers, and a slip layer. Each of the textile layers within the first grouping of textile layers contains a plurality of interwoven yarns or fibers having a tenacity of about 5 or more grams per denier. At least a portion of the spike resistant textile layers comprise about 10 wt. % or less, based on the total weight of the spike resistant textile layer, of a coating comprising a plurality of particles having a diameter of about 20 μm or less on at least one of the surfaces of the spike resistant textile layer. The slip layer has a stiffness of less than about 0.01 N-m and a static coefficient of friction (COF) between the slip layer and the second side of the first grouping of less than about 0.40. The pouch encapsulates the grouping of textile layers and slip layer. An article containing the package is also described.

13 Claims, 6 Drawing Sheets

(51) Int. Cl.

| | |
|---|---|
| ***A41D 1/06*** | (2006.01) |
| ***A41D 3/00*** | (2006.01) |
| ***A43B 7/32*** | (2006.01) |
| ***F41H 1/04*** | (2006.01) |
| ***F41H 1/02*** | (2006.01) |
| ***F41H 5/04*** | (2006.01) |
| ***A41D 31/24*** | (2019.01) |

(56) References Cited

U.S. PATENT DOCUMENTS

| | | | |
|---|---|---|---|
| 3,601,923 | A | 8/1971 | Rosenberg |
| 4,186,648 | A | 2/1980 | Clausen et al. |
| 4,292,882 | A | 10/1981 | Clausen |
| 4,425,080 | A | 1/1984 | Stanton et al. |
| 4,623,574 | A | 11/1986 | Harpell et al. |
| 4,690,825 | A | 9/1987 | Won |
| 4,879,165 | A | 11/1989 | Smith |
| 4,916,000 | A | 4/1990 | Li et al. |
| 4,961,685 | A | 10/1990 | Neubert |
| 4,969,386 | A | 11/1990 | Sandstrom et al. |
| 5,011,183 | A | 4/1991 | Thornton et al. |
| 5,035,111 | A | 7/1991 | Hogenboom et al. |
| 5,045,371 | A | 9/1991 | Calkins |
| 5,110,661 | A | 5/1992 | Groves |
| 5,145,675 | A | 9/1992 | Won |
| 5,225,241 | A | 7/1993 | Dischler |
| 5,275,873 | A | 1/1994 | Chitrangad |
| 5,322,721 | A | 6/1994 | McGinnis, Jr. et al. |
| 5,402,703 | A | 4/1995 | Drotleff |
| 5,437,905 | A | 8/1995 | Park |
| 5,443,882 | A | 8/1995 | Park |
| 5,443,883 | A | 8/1995 | Park |
| 5,466,503 | A | 11/1995 | Dischler |
| 5,547,536 | A | 8/1996 | Park |
| 5,569,509 | A | 10/1996 | Dischler |
| 5,580,629 | A | 12/1996 | Dischler |
| 5,776,839 | A | 7/1998 | Dischler et al. |
| 5,880,042 | A | 3/1999 | Schuster et al. |
| 6,133,169 | A | 10/2000 | Chiou et al. |
| 6,248,676 | B1 | 6/2001 | Dischler |
| 6,475,936 | B1 | 11/2002 | Chiou |
| 6,543,055 | B2 | 4/2003 | Howland et al. |
| 6,656,570 | B1 | 12/2003 | Fels et al. |
| 6,737,368 | B2 | 5/2004 | Chiou |
| 6,846,548 | B2 | 1/2005 | Harpell et al. |
| 6,893,989 | B2 | 5/2005 | Breukers |
| 7,642,206 | B1 | 1/2010 | Bhatnagar et al. |
| 7,825,048 | B2 | 11/2010 | Wang et al. |
| 8,236,711 | B1 | 8/2012 | Wang |
| 2002/0106957 | A1 | 8/2002 | Ritter |
| 2004/0016036 | A1* | 1/2004 | Bachner, Jr. ..... F41H 5/0485 2/2.5 |
| 2004/0048109 | A1 | 3/2004 | Granqvist et al. |
| 2004/0048538 | A1 | 3/2004 | Granqvist et al. |
| 2005/0266748 | A1 | 12/2005 | Wagner et al. |

FOREIGN PATENT DOCUMENTS

| | | |
|---|---|---|
| WO | WO 2006/121411 | 11/2006 |
| WO | WO 2010/142028 | 12/2010 |
| WO | WO 2011/024011 | 3/2011 |

OTHER PUBLICATIONS

Degussa AG, Aerosil®: Dispersions (2004).

Degussa AG, Aerodisp®: The Trusted Value of Arosil® in a Convenient Form (2004).

* cited by examiner

SPIKE RESISTANT PACKAGE AND ARTICLE

FIELD OF THE INVENTION

The present application is directed to spike resistant packages and articles such as spike resistant vests.

BACKGROUND

Police, correctional officers, security personnel, and even private individuals have a growing need for protection from spike threats that give good protection while being light and less expensive. It is a primary object to provide a flexible light weight structure that resists penetration by spike-like threats.

BRIEF SUMMARY OF THE INVENTION

A spike resistant package containing a pouch, a first grouping of spike resistant textile layers, and a slip layer. Each of the textile layers within the first grouping of textile layers contains a plurality of interwoven yarns or fibers having a tenacity of about 5 or more grams per denier. At least a portion of the spike resistant textile layers comprise about 10 wt. % or less, based on the total weight of the spike resistant textile layer, of a coating comprising a plurality of particles having a diameter of about 20 μm or less on at least one of the surfaces of the spike resistant textile layer. The slip layer has a stiffness of less than about 0.01 N-m and a static coefficient of friction (COF) between the slip layer and the second side of the first grouping of less than about 0.40. The pouch encapsulates the grouping of textile layers and slip layer. An article containing the package is also described.

A spike resistant package containing a pouch, a first grouping of spike resistant textile layers, and a slip layer. Each of the textile layers within the first grouping of textile layers contains a plurality of interwoven yarns or fibers having a tenacity of about 5 or more grams per denier. The slip layer has a thickness of less than about 0.1 mm, a stiffness of less than about 0.01 N-m, and a static coefficient of friction (COF) between the slip layer and the second side of the first grouping of less than about 0.40. The pouch essentially fully encapsulates the grouping of spike resistant textile layers and the slip layer and the slip layer and the inner surface of the pouch are in direct and intimate contact. An article containing the package is also described.

A spike resistant package containing a pouch, a first grouping of spike resistant textile layers where the inner surface of the pouch has a static COF between the inner surface of the pouch and the second side of the first grouping of less than about 0.40. Each of the textile layers within the first grouping of textile layers contains a plurality of interwoven yarns or fibers having a tenacity of about 5 or more grams per denier. At least a portion of the spike resistant textile layers comprise about 10 wt. % or less, based on the total weight of the spike resistant textile layer, of a coating comprising a plurality of particles having a diameter of about 20 μm or less on at least one of the surfaces of the spike resistant textile layer. The pouch essentially fully encapsulates the grouping of spike resistant textile layers and the slip layer and the slip layer and the inner surface of the pouch are in direct and intimate contact. An article containing the package is also described.

A spike resistant package containing a pouch, a first grouping of spike resistant textile layers and a second grouping of spike resistant textile layers, wherein the static COF between the second side of the first grouping and the inner surface of the pouch is less than about 0.40. Each of the textile layers within the first and second grouping of textile layers contains a plurality of interwoven yarns or fibers having a tenacity of about 5 or more grams per denier. At least a portion of the spike resistant textile layers comprise about 10 wt. % or less, based on the total weight of the spike resistant textile layer, of a coating comprising a plurality of particles having a diameter of about 20 μm or less on at least one of the surfaces of the spike resistant textile layer. The spike resistant woven textile layers of the first grouping have a weave density of between about 20 and 45 warp and weft yarns per inch. The spike resistant woven textile layers of the second grouping have a weave density of between about 15 and 35 warp and weft yarns per inch. The pouch essentially fully encapsulates the first and second grouping of spike resistant textile layers. An article containing the package is also described. Preferably, there should be smaller denier yarns in the first grouping and the higher denier yarns in the second grouping. By using the higher denier yarns, the fabric is inherently less expensive, but the lower denier yarns are beneficial to achieve a lower overall weight package.

DETAILED DESCRIPTION OF THE INVENTION

As utilized herein, the term "spike resistant" is generally used to refer to a material that provides protection against penetration of the material by sharp-pointed weapons or objects, such as an ice pick or a shank made by a prisoner. Thus, a "spike resistant" material can either prevent penetration of the material by such an object or can lessen the degree of penetration of such an object as compared to similar, non-spike resistant materials. Preferably, a "spike resistant" material achieves a pass rating when tested against Level 1, Spike class threats in accordance with National Institute of Justice (NIJ) Standard 0115.00 (2000), entitled "Stab Resistance of Personal Body Armor." The term "spike resistant" can also refer to materials (e.g., a composite according to the invention) achieving a pass rating when tested against higher level threats (e.g., Level 2 or Level 3).

In certain possibly preferred embodiments, the invention can also be directed to a spike resistant package that also has knife and/or ballistic resistant properties.

When a spike strikes the first grouping of spike resistant textile layers without a pouch, the spike resistant textile layers can move freely and interact fully with the spike, dissipating energy effectively. When the spike resistant textile layers are enclosed inside a pouch, the movement of the spike resistant textile layers is restricted if the COF between the inner surface of the pouch and the second side of the spike resistant textile layer is high. As a result, the spike resistant textile layers are not able to interact fully with the spike to effectively dissipate energy. When a slip layer with low COF and/or when a pouch with a low COF inner surface is used, the interaction between the spike resistant textile layers and the inner surface of the pouch is reduced, allowing the spike resistant textile layers to interact with the spike and dissipate energy more effectively.

Figure 1:
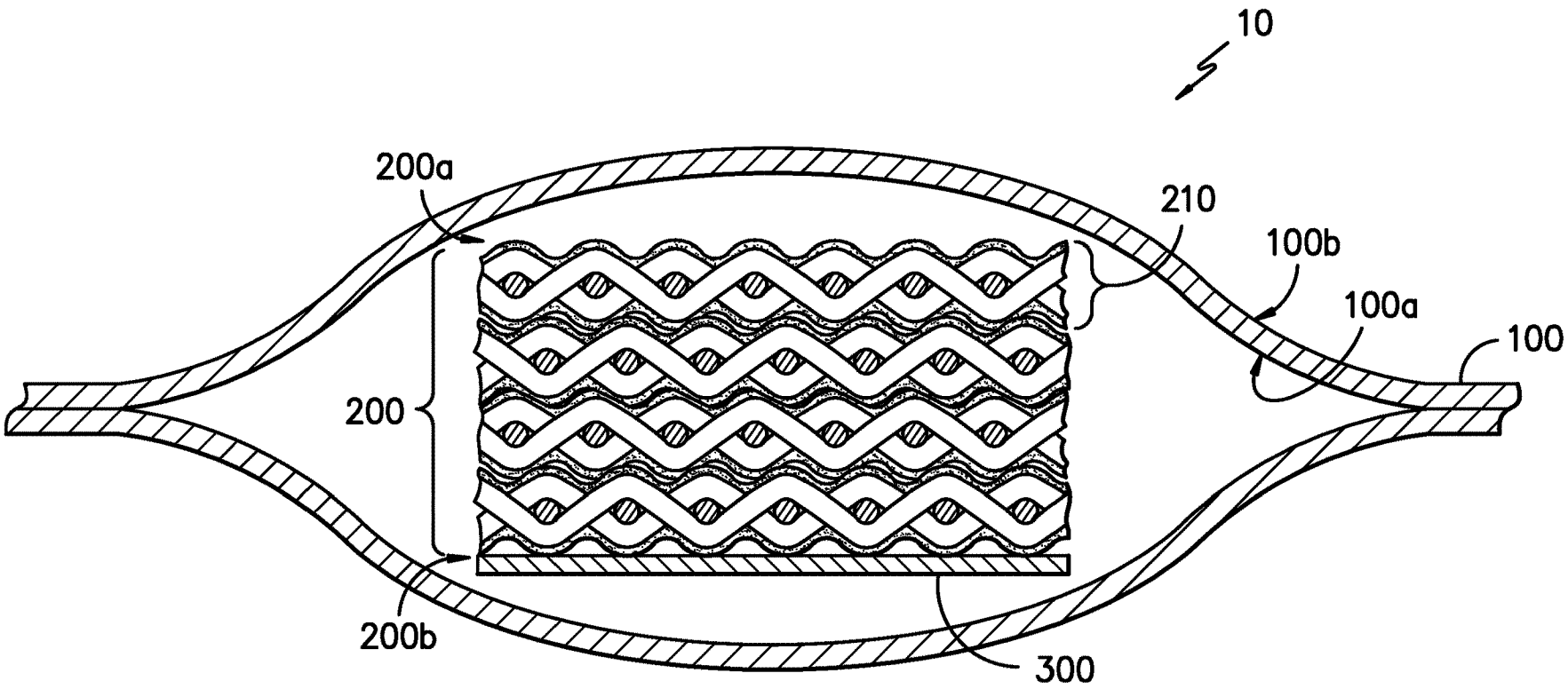
FIG. 1 is a sectional view of one embodiment of a spike resistant package.
Figure 2:
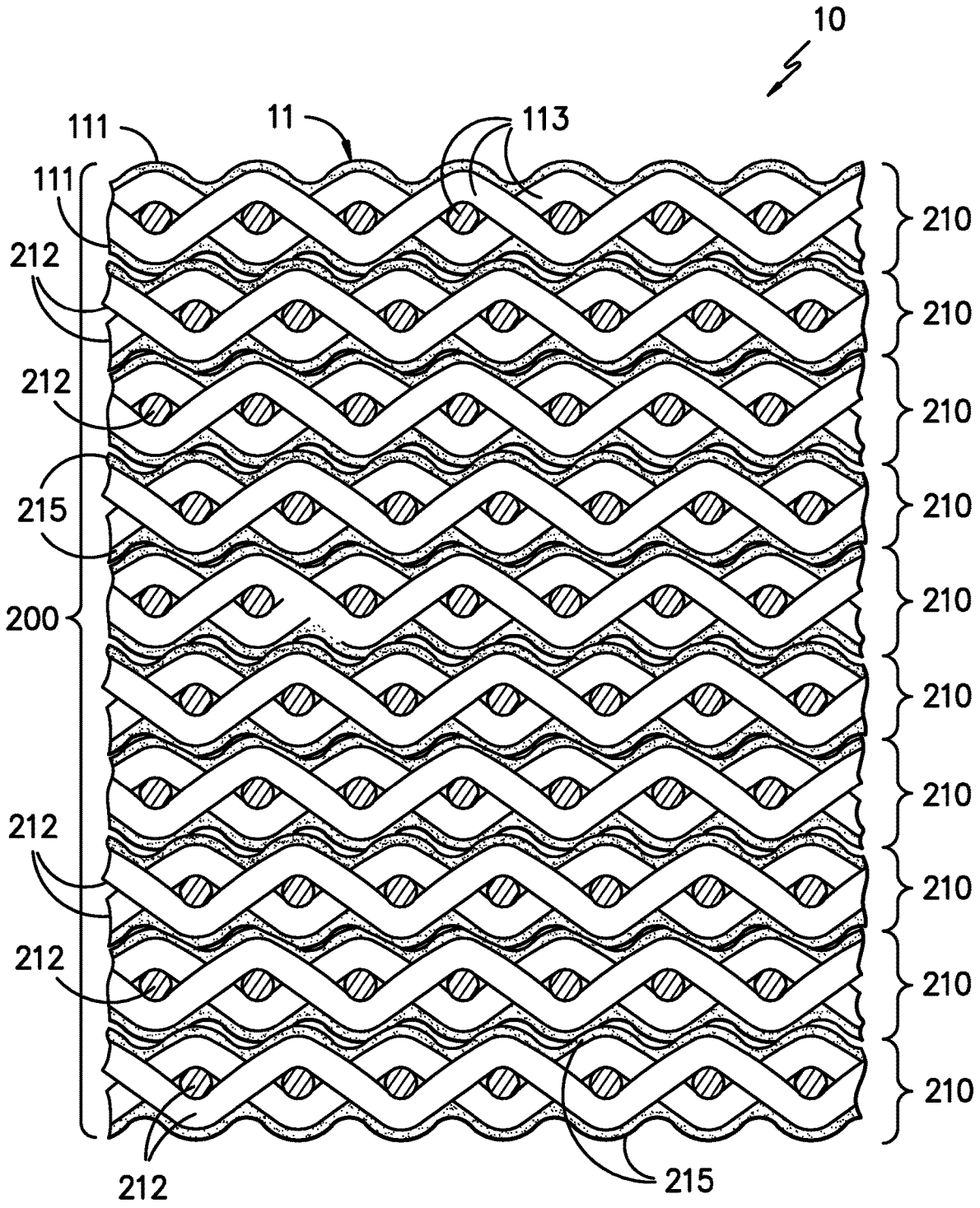
FIG. 2 is a cross-sectional view of one embodiment of the first grouping of spike resistant textile layers.

Referring now to FIG. 1, in one embodiment the spike resistant package 10 contains a pouch 100 which contains the first grouping 200 of spike resistant layers 210 and the slip layer 300. The pouch 100 contains an inner surface 100*a* and an outer surface 100*b*. The pouch 100 at least partially surrounds the first grouping 200 of spike resistant layers 210 and the slip layer 300, more preferably, fully surrounds and encapsulates the first grouping 200 of spike resistant layers 210 and the slip layer 300.

In one embodiment, the pouch 100 comprises a pouch textile. The pouch textile can be any suitable textile including a woven, knit, or nonwoven textile. The pouch textile can be made from fibers such as polyester, nylon, or other common fiber materials. It can be dyed and finished to impart color, moisture resistance, and/or flame resistance. The textile can be back-coated to impart enhanced performance in water, air, or flame resistance with polyurethane, acrylic, or other back-coating materials. In another embodiment, the pouch 100 may be a polymeric film, with or without fiber reinforcements.

The first grouping of textile layers 200 has a first side 200*a* and a second side 200*b*. The spike resistant textile layers 210 are preferably woven textiles. Each spike resistant textile layer 210 contains a plurality of interlocking yarns or fibers 212 having a tenacity of about 5 or more grams per denier, more preferably about 8 or more, more preferably about 10 or more, more preferably about 14 or more, more preferably 15 or more. In a preferred embodiment, the plurality of yarns or fibers 212 have a tenacity of about 10 or more grams per denier and have a size of less than ten denier per filament, more preferably less than 5 denier per filament. In one embodiment, the fibers have an average diameter of less than about 20 micrometers, more preferably less than about 10 micrometers. The spike resistant textile layers 210 can have any suitable weight. In certain possibly preferred embodiments, the spike resistant textile layers 212 can have a weight of about 2 to about 10 ounces per square yard.

For the fibers or yarns interwoven in the spike resistant textile layers 210 a non-inclusive listing of suitable fibers and yarns include, fibers made from highly oriented polymers, such as gel-spun ultrahigh molecular weight polyethylene fibers, melt-spun polyethylene fibers, melt-spun nylon fibers, melt-spun polyester fibers, and sintered polyethylene fibers. Suitable fibers also include those made from rigid-rod polymers, such as lyotropic rigid-rod polymers, heterocyclic rigid-rod polymers, and thermotropic liquid-crystalline polymers. Suitable fibers made from lyotropic rigid-rod polymers include aramid fibers, such as poly(p-phenylene-terephthalamide) fibers and fibers made from a 1:1 copolyterephthalamide of 3,4'-diaminodiphenylether and p-phenylenediamine. Suitable fibers made from heterocyclic rigid-rod polymers, such as p-phenylene heterocyclics, include poly(p-phenylene-2,6-benzobisoxazole) fibers (PBO fibers), poly(p-phenylene-2,6-benzobisthiazole) fibers (PBZT fibers), and poly[2,6-diimidazo[4,5-b:4',5'-e] pyridinylene-1,4-(2,5-dihydroxy)phenylene] fibers (PIPD fibers). Suitable fibers made from thermotropic liquid-crystalline polymers include poly(6-hydroxy-2-napthoic acid-co-4-hydroxybenzoic acid) fibers. Suitable fibers also include carbon fibers, such as those made from the high temperature pyrolysis of rayon, polyacrylonitrile, and mesomorphic hydrocarbon tar. In certain possibly preferred embodiments, the yarns or fibers 113 and 212 comprise fibers selected from the group consisting of gel-spun ultrahigh molecular weight polyethylene fibers, melt-spun polyethylene fibers, melt-spun nylon fibers, melt-spun polyester fibers, sintered polyethylene fibers, aramid fibers, PBO fibers, PBZT fibers, PIPD fibers, poly(6-hydroxy-2-napthoic acid-co-4-hydroxybenzoic acid) fibers, carbon fibers, and combinations thereof. In one particularly preferred embodiment, the spike resistant textile layer 210 comprises aramid fibers 212. In another particularly preferred embodiment, the strike face layer 110 comprises aramid fibers 113.

In one embodiment, at least a portion of the spike resistant textile layers 210 comprise about 10 wt. % or less, based on the total weight of the textile layer, of a coating comprising a plurality of particles having a diameter of about 20 μm or less on at least one side of the textile layer 210. More preferably, the plurality of particles having a diameter of about 4 μm or less, more preferably a diameter of about 2 μm or less. In one embodiment, at least 50% by number of the textile layers 210 contain the coating. In another embodiment, at least 75% by number, more preferably at least about 90% by number of the textile layers 210 contain the coating. In another embodiment, each (essentially 100% by number) of the textile layers 210 contain the coating. The first group 200 preferably contains at least 2 spike resistant textile layers 210, more preferably at least about 3 layers, more preferably at least about 4 layers. While the spike resistant textile layer 210 is described as being spike resistant, the textile layer 210 may also have knife and/or ballistic resistant properties.

It has been found that the particle treated spike resistant textile layers 210 had significantly higher spike penetration resistance as compared to the same construction of textile layers without the particles. The key mechanism of improved spike penetration resistance of the treated fabric is believed to be inter-layer interactions.

The spike resistant textile layers 210 can have any suitable construction. The spike resistant textile layers 210 can comprise a plurality of yarns provided in a knit or woven construction. The construction of the textile layers 210 resists slippage of the fibers or yarns past one another. Alternatively, the spike resistant textile layers 210 can comprise a plurality of fibers provided in a suitable nonwoven construction (e.g., a needle-punched nonwoven, etc.).

For the embodiment where the spike resistant textile layers are in a woven construction, the woven layer preferably includes a multiplicity of warp and weft elements interwoven together such that a given weft element extends in a predefined crossing pattern above and below the warp element. One preferred weave is the plain weave where each weft element passes over a warp element and thereafter passes under the adjacent warp element in a repeating manner across the full width of the textile layer. Thus, the terms "woven" and "interwoven" are meant to include any construction incorporating interengaging formation fibers or yarns.

As will be understood by those of ordinary skill in the art, each textile layer within the grouping (or from one grouping to the next) can be independently provided in each of the aforementioned suitable constructions. For example, the first grouping 200 may have five (5) spike resistant textile layers 210 in a knit construction and five (5) spike resistant textile layers 210 in a woven construction. The different constructions may be grouped together, arranged in a repeating pattern or arranged randomly. In certain possibly preferred embodiments, the spike resistant textile layers 210 comprise a plurality of yarns 212 provided in a woven construction. In one embodiment, the textile layers 210 of the first group grouping 200 have a weave density of between about 20 and 45 warps and wefts per inch, more preferably between about 25 and 45 warps and wefts per inch.

In one embodiment, the spike resistance textile layers 210 have a tightness factor of greater than about 0.75 as defined in U.S. Pat. No. 6,133,169 (Chiou) and U.S. Pat. No. 6,103,646 (Chiou), which are incorporated herein by reference. "Fabric tightness factor" and "Cover factor" are names given to the density of the weave of a fabric. Cover factor is a calculated value relating to the geometry of the weave and indicating the percentage of the gross surface area of a fabric that is covered by yarns of the fabric. The equation used to calculate cover factor is as follows (from Weaving: Conversion of Yarns to Fabric, Lord and Mohamed, published by Merrow (1982), pages 141-143):

$d_w$=width of warp yarn in the fabric $d_f$=width of fill yarn in the fabric $p_w$=pitch of warp yarns (ends per unit length)

$p_f$=pitch of fill yarns $$C_w = \frac{d_w}{p_w} C_f = \frac{d_f}{p_f}$$

$$\text{Fabric_Cover_Factor} = Cfab = \frac{\text{total_area_obsured}}{\text{area_enclosed}}$$

$$C_{fab} = \frac{(p_w - d_w)d_f + d_w p_f}{p_w p_f}$$

$$C_{fab} = (C_f + C_w - C_f C_w)$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric_tightness_factor} = \frac{\text{actual_cover_factor}}{\text{maximum_cover_factor}}$$

For example, the maximum cover factor that is possible for a plain weave fabric is 0.75; and a plain weave fabric with an actual cover factor of 0.68 will, therefore, have a fabric tightness factor of 0.91. The preferred weave for practice of this invention is plain weave.

The yarns or fibers 212 of the spike resistant textile layers 210 can comprise any suitable fibers. Yarns or fibers 212 suitable for use in the spike resistant textile layer 210 generally include, but are not limited to, high tenacity and high modulus yarns or fibers, which refers to yarns that exhibit a relatively high ratio of stress to strain when placed under tension. In order to provide adequate protection against ballistic projectiles, the yarns or fibers of the spike resistant textile layers 210 typically have a tenacity of about 8 or more grams per denier. In certain possibly preferred embodiments, the yarns or fibers of the spike resistant textile layers 210 can have a tenacity of about 10 or more grams per denier, more preferably 15 or more grams per denier.

Figure 3A:
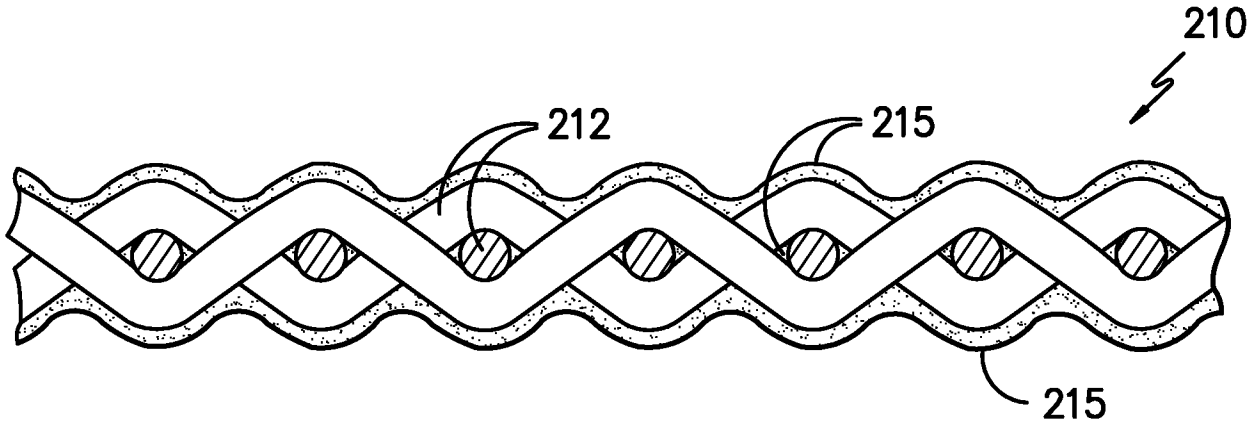
FIGS. 3A, 3B, and 3C illustrate schematically cross-section of different embodiments of the spike resistant textile layers.
Figure 3B:
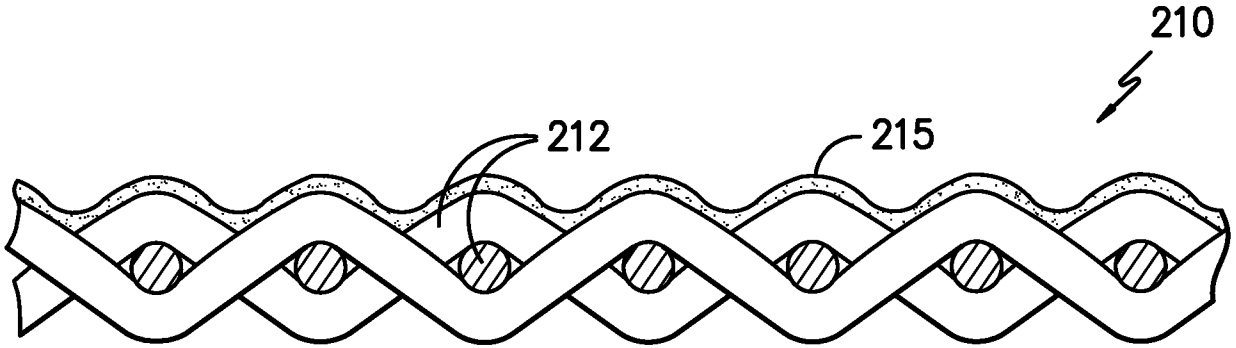
Figure 3C:
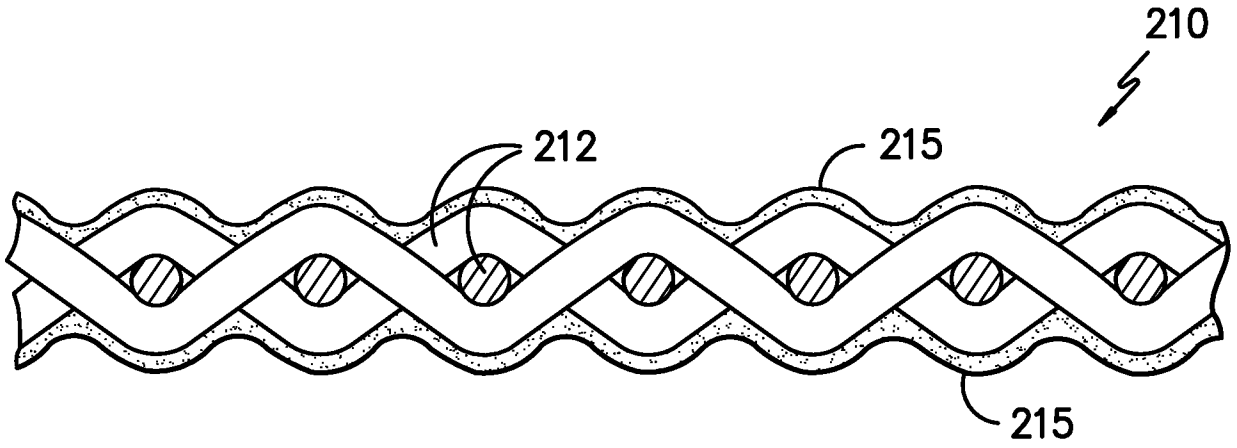

Referring to FIG. 3, which is an enlarged view of the first grouping, it can be seen that the spike resistant textile layers 210 comprises a coating 215 on at least a surface thereof in a weight of about 10 wt. % or less, based on the total weight of the textile layer, of a coating comprising a plurality of particles having a diameter of about 20 μm or less. In certain possibly preferred embodiments, the coating can penetrate into the interior portion of the textile layer 210 to at least partially coat the yarns or fibers 212 of the spike resistant textile layer 210. FIG. 5A shows a spike resistant textile layer 210 with the coating 215 on both sides and in the interior of the fibers 212. FIG. 5B shows a spike resistant textile layer 210 with the coating 215 applied to one surface of the spike resistant textile layer 210. FIG. 5C shows a spike resistant textile layer 210 with the coating 215 on both sides of the fibers 212.

The coating 215 applied to the spike resistant textile layers 210 comprises particulate matter (e.g., a plurality of particles). The particles included in the coating 215 can be any suitable particles, but preferably are particles having a diameter of about 20 μm or less, or about 10 μm or less, or about 1 μm or less (e.g., about 500 nm or less or about 300 nm or less). Particles suitable for use in the coating include, but are not limited to, silica particles, (e.g., fumed silica particles, precipitated silica particles, alumina-modified colloidal silica particles, etc.), alumina particles (e.g. fumed alumina particles), and combinations thereof. In certain possibly preferred embodiments, the particles are comprised of at least one material selected from the group consisting of fumed silica, precipitated silica, fumed alumina, alumina modified silica, zirconia, titania, silicon carbide, titanium carbide, tungsten carbide, titanium nitride, silicon nitride, and the like, and combinations thereof. Such particles can also be surface modified, for instance by grafting, to change surface properties such as charge and hydrophobicity. Suitable commercially available particles include, but are not limited to, the following: CAB-O-SPERSE® PG003 fumed alumina, which is a 40% by weight solids aqueous dispersion of fumed alumina available commercially from Cabot Corporation of Boyertown, Pa. (the dispersion has a pH of 4.2 and a median average aggregate particle size of about 150 nm); SPECTRAL™ 51 fumed alumina, which is a fumed alumina powder available commercially from Cabot Corporation of Boyertown, Pa. (the powder has a BET surface area of 55 $m^2/g$ and a median average aggregate particle size of about 150 nm); CAB-O-SPERSE® PG008 fumed alumina, which is a 40% by weight solids aqueous dispersion of fumed alumina available commercially from Cabot Corporation of Boyertown, Pa. (the dispersion has a pH of 4.2 and a median average aggregate particle size of about 130 nm); SPECTRAL™ 81 fumed alumina, which is a fumed alumina powder available commercially from Cabot Corporation of Boyertown, Pa. (the powder has a BET surface area of 80 $m^2/g$ and a median average aggregate particle size of about 130 nm); AEROXIDE ALU C fumed alumina, which is a fumed alumina powder available commercially from Degussa, Germany (the powder has a BET surface area of 100 $m^2/g$ and a median average primary particle size of about 13 nm); LUDOX® CL-P colloidal alumina coated silica, which is a 40% by weight solids aqueous sol available from Grace Davison (the sol has a pH of 4 and an average particle size of 22 nm in diameter); NALCO® 1056 aluminized silica, which is a 30% by weight solids aqueous colloidal suspension of aluminized silica particles (26% silica and 4% alumina) available commercially from Nalco; LUDOX® TMA colloidal silica, which is a 34% by weight solids aqueous colloidal silica sol available from Grace Davison. (the sol has a pH of 4.7 and an average particle size of 22 nm in diameter); NALCO® 88SN-126 colloidal titanium dioxide, which is a 10% by weight solids aqueous dispersion of titanium dioxide available commercially from Nalco; CAB-O-SPERSE® S3295 fumed silica, which is a 15% by weight solids aqueous dispersion of fumed silica available commercially from Cabot Corporation of Boyertown, Pa. (the dispersion has a pH of 9.5 and an average agglomerated primary particle size of about 100 nm in diameter); CAB-O-SPERSE® 2012A fumed silica, which is a 12% by weight solids aqueous dispersion of fumed silica available commercially from Cabot Corporation of Boyertown, Pa. (the dispersion has a pH of 5); CAB-O-SPERSE® PG001 fumed silica, which is a 30% by weight solids aqueous dispersion of fumed silica available commercially from Cabot Corporation of Boyertown, Pa. (the dispersion has a pH of 10.2 and a median aggregate particle size of about 180 nm in diameter); CAB-O-SPERSE® PG002 fumed silica, which is a 20% by weight solids aqueous dispersion of fumed silica available commercially from Cabot Corporation of Boyertown, Pa. (the dispersion has a pH of 9.2 and a median aggregate particle size of about 150 nm in diameter); CAB-O-SPERSE® PG022 fumed silica, which is a 20% by weight solids aqueous dispersion of fumed silica available commercially from Cabot Corporation of Boyertown, Pa. (the dispersion has a pH of 3.8 and a median aggregate particle size of about 150 nm in diameter); SIPERNAT® 22LS precipitated silica, which is a precipitated silica powder available from Degussa of Germany (the powder has a BET surface area of 175 $m^2/g$ and a median average primary particle size of about 3 μm); SIPERNAT® 500LS precipitated silica, which is a precipitated silica powder available from Degussa of Germany (the powder has a BET surface area of 450 $m^2/g$ and a median average primary particle size of about 4.5 μm); and VP Zirconium Oxide fumed zirconia, which is a fumed zirconia powder available from Degussa of Germany (the powder has a BET surface area of 60 $m^2/g$).

In certain possibly preferred embodiments, the particles can have a positive surface charge when suspended in an aqueous medium, such as an aqueous medium having a pH of about 4 to 8. Particles suitable for use in this embodiment include, but are not limited to, alumina-modified colloidal silica particles, alumina particles (e.g. fumed alumina particles), and combinations thereof. In certain possibly preferred embodiments, the particles can have a Mohs' hardness of about 5 or more, or about 6 or more, or about 7 or more. Particles suitable for use in this embodiment include, but are not limited to, fumed alumina particles. In certain possibly preferred embodiments, the particles can have a three-dimensional branched or chain-like structure comprising or consisting of aggregates of primary particles. Particles suitable for use in this embodiment include, but are not limited to, fumed alumina particles, fumed silica particles, and combinations thereof.

The particles included in the coating can be modified to impart or increase the hydrophobicity of the particles. For example, in those embodiments comprising fumed silica particles, the fumed silica particles can be treated, for example, with an organosilane in order to render the fumed silica particles hydrophobic. Suitable commercially-available hydrophobic particles include, but are not limited to, the R-series of AEROSIL® fumed silicas available from Degussa, such as AEROSIL® R812, AEROSIL® R816, AEROSIL® R972, and AEROSIL® R7200. While not wishing to be bound to any particular theory, it is believed that using hydrophobic particles in the coating will minimize the amount of water that the layers and panel will absorb when exposed to a wet environment. When hydrophobic particles are utilized in the coating on the textile layers 210, the hydrophobic particles can be applied using a solvent-containing coating composition in order to assist their application. Such particles and coatings are believed to be more fully described in U.S. Patent Publication No. 2007/0105471 (Wang et al.), incorporated herein by reference.

The spike resistant textile layers 210 can comprise any suitable amount of the coating 215. As will be understood by those of ordinary skill in the art, the amount of coating applied to the spike resistant textile layers 210 generally should not be so high that the weight of the flexible panel 10 is dramatically increased, which could potentially impair certain end uses for the panel 10. Typically, the amount of coating 215 applied to the spike resistant textile layers 210 will comprise about 10 wt. % or less of the total weight of the textile layer 210. In certain possibly preferred embodiments, the amount of coating applied to the spike resistant textile layers 210 will comprise about 5 wt. % or less or about 3 wt. % or less (e.g., about 2 wt. % or less) of the total weight of the textile layer 210. Typically, the amount of coating applied to the spike resistant textile layers 210 will comprise about 0.1 wt. % or more (e.g., about 0.5 wt. % or more) of the total weight of the textile layer 210. In certain possibly preferred embodiments, the coating comprises about 2 to about 4 wt. % of the total weight of the textile layer 210.

In certain possibly preferred embodiments of the spike resistant package 10, the coating 215 applied to the spike resistant textile layers 210 can further comprise a binder. The binder included in the coating 215 can be any suitable binder. Suitable binders include, but are not limited to, isocyanate binders (e.g., blocked isocyanate binders), acrylic binders (e.g, nonionic acrylic binders), polyurethane binders (e.g., aliphatic polyurethane binders and polyether based polyurethane binders), epoxy binders, and combinations thereof. In certain possibly preferred embodiments, the binder is a cross-linking binder, such as a blocked isocyanate binder.

When present, the binder can comprise any suitable amount of the coating applied to the spike resistant textile layers 210. The ratio of the amount (e.g., weight) of particles present in the coating to the amount (e.g., weight) of binder solids present in the coating 215 typically is greater than about 1:1 (weight particles: weight binder solids). In certain possibly preferred embodiments, the ratio of the amount (e.g., weight) of particles present in the coating 215 to the amount (e.g., weight) of binder solids present in the coating typically is greater than about 2:1, or greater than about 3:1, or greater than about 4:1, or greater than about 5:1 (e.g., greater than about 6:1, greater than about 7:1, or greater than about 8:1). It is noted that when the coating 215 is applied to the spike resistant layer, the spike layer can have a much lower fabric tightness fabric to achieve the same level of spike resistance.

In certain possibly preferred embodiments, the coating 215 applied to the spike resistant textile layers 210 can comprise a water-repellant in order to impart greater water repellency to the flexible panel 10. The water-repellant included in the coating can be any suitable water-repellant including, but not limited to, fluorochemicals or fluoropolymers.

In one embodiment, the package 10 contains a second grouping of spike resistant fibers. The first and second groupings may have the same or different yarns/fibers, construction, weave density, particle coating. In one embodiment, the second grouping is on the first side 200*a* of the first grouping 200 and contains woven spike resistant layer having a tighter weave than the textile layers 210 of the first grouping 200. In one embodiment, the second grouping has a weave density of between about 30 and 80 warp yarns per inch and between about 30 and 80 weft yarns per inch. In another embodiment, the second grouping is on the first side 200*a* of the first grouping 200 and contains woven spike resistant layer having a looser weave than the textile layers 210 of the first grouping 200. In one embodiment, the second grouping has a weave density of between about 15 and 35 warp yarns per inch and between about 15 and 35 weft yarns per inch. The second grouping may have less, the same, or more textile layers than the first grouping 200. In one embodiment, only one grouping contains the particle coatings (and the other groupings would not contain particle coatings).

Referring back to FIG. 1, there is shown a slip layer 300 in the package 10 within the pouch 100. The slip layer can be any suitable layer and is placed on the second side 200*b* of the grouping of spike resistant layer 200. When the package 10 is placed into an article, preferably the package 10 is oriented such that the slip layer 300 is between each side of the grouping 200 and the pouch 100. More preferably the slip layer is closer to the wearer of the article than the grouping 200. The slip layer 300 may be loose within the pouch or may be adhered or otherwise attached to the inner surface 100*a* of the pouch 100 or the grouping 200. The slip layer 300 is preferably in intimate contact with the inner surface 100*a* of the pouch 100, meaning that the slip layer 300 is in direct contact with the inner surface 100*a* with essentially nothing between them. The slip layer may also be positioned between layers of the grouping 200.

Preferably, the slip layer is a polymeric film, preferably an oriented thermoplastic polymeric film. In one embodiment, the slip layer has a thickness of less than about 0.2 mm, more preferably less than about 0.1 mm. The slip layer preferably has a low static coefficient of friction (COF) in contact with the textile layers which enables the textile layers and their yarns to slide relative to the inner surface of the pouch. Static COF is measured following ASTM D1894—Standard Test Method for Static and Kinetic Coefficients of Friction of Plastic Film and Sheeting. The dynamic or kinetic COF is the steady state resistance to movement between the two materials tested with a constant load of 200 gf and a constant velocity of 150 mm/min. The static COF is the initial resistance to the movement. Preferably, the static COF between the second side 200*b* of the first grouping of spike resistant textile layers 200 and the slip layer 300 is less than about 0.50. In one embodiment, the static between the slip layer 300 and the inner surface 100*a* of the pouch 100 is less than about 0.45 and more preferably less than 0.40. In the embodiments where the slip layer is incorporated into the pouch or is absent, then preferably static COF between the second side 200*b* of the first grouping of spike resistant textile layers 200 and the inner surface 100*a* of the pouch 100 is less than about 0.40.

The slip layer allows the spike resistant textile layers to move readily relative to the pouch inner surface allowing the spike to be more effectively stopped from penetrating the pack. When the layers are rigidly held by high resistance to slipping, they are less able to absorb the energy of the spike threat. Slippage between the body side layers and the inner pouch appears to be the most helpful in resisting penetration but one could envision that slippage between other layers in the pack could prove beneficial, too.

In one embodiment, the package 10 contains additional slip layers. These additional slip layers can be of the same materials and properties as the first slip layer 300 or may use different materials and have different properties. The additional slip layers may be in any suitable location within the pouch 100, for example, an additional slip layer on the inner surface of the pouch 100 on the second side 200*b* of the grouping 200, on the inner surface of the pouch 100 on the first side 200*a* of the grouping 200, within the grouping 200 between the spike resistant textile layers 210, and between the first grouping and second grouping of spike resistant textile layers.

Figure 4:
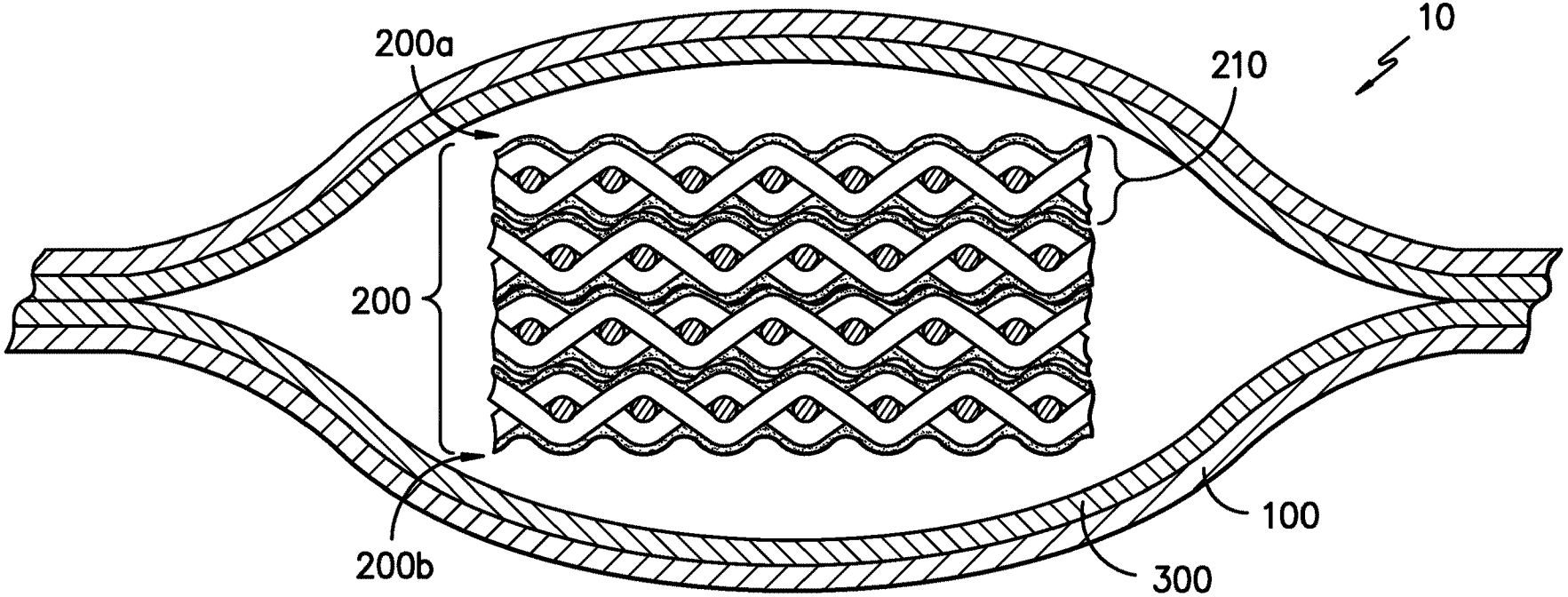
FIG. 4 is a sectional view of one embodiment of a spike resistant package.

In one embodiment shown in FIG. 4, there is shown an alternative embodiment where the slip layer 300 is incorporated into the pouch 100. In one embodiment, the slip layer 300 and the pouch 100 are co-extruded together. In another embodiment, the slip layer is coated, adhered, laminated, or otherwise attached to an already formed pouch 100. In one preferred embodiment, the pouch is formed from a woven fabric and the slip layer is coated onto the fabric. Thus, in this embodiment, the slip layer 300 forms inner surface 100*a* of the pouch 300. In another embodiment, the package does not contain a slip layer 300 between the second side of the first grouping and the inner surface of the pouch. The low friction inner surface of the pouch may be achieved through the selection of yarns, coatings or treatments to yarns, agents that bloom to the surface during manufacture of yarns or films, or coatings or treatments to the inner surface of the pouch.

Figure 5:
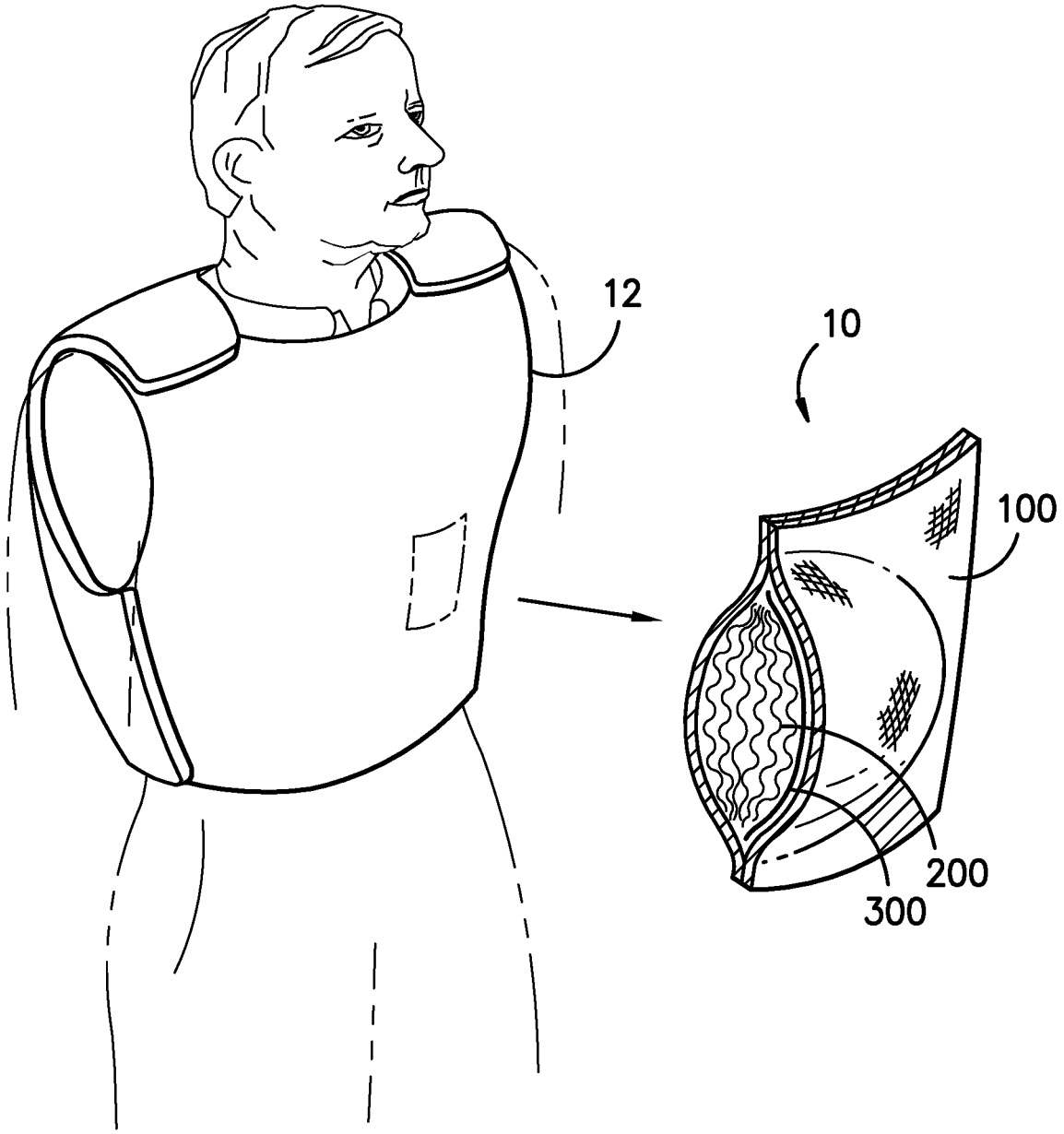
FIG. 5 is an illustration of one embodiment of an article containing a spike resistant package.

In one embodiment, the spike resistant package 10 is flexible, where flexible is defined to be able to be bent to a radius of one foot or less without effecting performance. The spike resistant package 10 of the invention is particularly well suited for use in personal protection devices, such as personal body armor. For example, as depicted in FIG. 5, the spike resistant package 10 can be incorporated into an article 12 (in this figure a vest) in order to provide the wearer protection against spike threats.

In one embodiment, the package 10 is incorporated into an article to protect the user from spike threats. Some articles include shirts, jackets, pants, vests, shoes, helmets, and hats. In one embodiment, the article contains a slot or pocket that the package 10 can be placed in and out of. Preferably, the package 10 is easily removable from the article for laundering.

In another embodiment, the package 10 may also contain layers directed towards knife and/or ballistics resistance. The makeup of these additional layers would be chosen by the desired package properties as well as the location of these layers within the package 10. The additional layers may add additional spike, knife, and/or ballistic resistance or other desired properties. Examples of suitable known puncture resistant materials or components include, but are not limited to, mail (e.g., chain mail), metal plating, ceramic plating, layers of textile materials made from high tenacity yarns which layers have been impregnated or laminated with an adhesive or resin, or textile materials made from low denier high tenacity yarns in a tight woven form such as DuPont KEVLAR CORRECTIONAL® available from DuPont.

Commercially-available, flexible ballistic resistant panels such as those described above include, but are not limited to, the SPECTRA SHIELD® high-performance ballistic materials sold by Honeywell International Inc. Such ballistic resistant laminates are believed to be more fully described in U.S. Pat. No. 4,916,000 (Li et al.); U.S. Pat. No. 5,437,905 (Park); U.S. Pat. No. 5,443,882 (Park); U.S. Pat. No. 5,443, 883 (Park); and U.S. Pat. No. 5,547,536 (Park), each of which is herein incorporated by reference. Other commercially available high performance flexible ballistic resistant materials include DYNEEMA UD® available from DSM Dymeema, and GOLDFLEX® available from Honeywell International Inc. These high performance flexible ballistic materials may be used together with the spike resistant package 10 to enhance overall ballistic performance.

The process to form the spike resistant textile layers 210 where the spike resistant textile layers 210 comprising a plurality of interwoven yarns or fibers having a tenacity of about 5 or more grams per denier, wherein at least one of the surfaces of the spike resistant textile layer comprises about 10 wt. % or less, based on the total weight of the textile layer, of a coating comprising a plurality of particles having a diameter of about 20 μm or less comprises the steps of (a) providing a first textile layer, (b) contacting at least one of the lower surface of the first textile layer with a coating composition comprising a plurality of particles having a diameter of about 20 μm or less, and (c) drying the textile layer treated in step (b) to produce a coating on the lower surface of the first textile layer or the upper surface of the second textile layer.

The surface(s) of the textile layers can be contacted with the coating composition in any suitable manner. The textile layers can be contacted with the coating composition using conventional padding, spraying (wet or dry), foaming, printing, coating, and exhaustion techniques. For example, the textile layers can be contacted with the coating composition using a padding technique in which the textile layer is immersed in the coating composition and then passed through a pair of nip rollers to remove any excess liquid. In such an embodiment, the nip rollers can be set at any suitable pressure, for example, at a pressure of about 280 kPa (40 psi). Alternatively, the surface of the textile layer to be coated can be first coated with a suitable adhesive, and then the particles can be applied to the adhesive.

The coated textile layers can be dried using any suitable technique at any suitable temperature. For example, the textile layers can be dried on a conventional tenter frame or range at a temperature of about 160° C. (320° F.) for approximately five minutes. The formed spike resistant textile layer comprises about 10 wt. % or less, based on the total weight of the textile layer, of a coating comprising a plurality of particles having a diameter of about 20 μm or less may be found in U.S. Patent Publication 2007/0105471 (Wang et al.), incorporated herein by reference.

The layers 210 can be disposed adjacent to each other and held in place relative to each other by a suitable enclosure, such as a pocket or can be attached to each other by any known fastening means. In certain possibly preferred embodiments the layers 110 and 210 can also be sewn together in a desired pattern, for example, around the corners or along the perimeter of the stacked textile layers in order to secure the layers in the proper or desired arrangement. Additionally, the layers 210 and 110 may be adhered together using a patterned adhesive or other fastening means such as rivets, bolts, wires, tape, or clamps. In one embodiment, the layers are loose (not attached to each other using any adhesive or mechanical means are placed together within the pouch.

EXAMPLES

Various embodiments of the invention are shown by way of the Examples below, but the scope of the invention is not limited by the specific Examples provided herein.

Test Methods

Spike Resistance Test Method

Spike stab resistance was tested according to NIJ Standard 0115.00 (2000), entitled "Stab Resistance of Personal Body Armor". The stab energy of the drop mass was set at 65 J (Protection Level 3 at "E2" strike energy). "Passing" is defined to be a penetration of less than 20 mm. The NIJ engineered spikes were used as the threat weapon purchased from Precision Machine Works.

Pouch Material

The nylon pouch of the package was a back-coated, water resistant nylon bag sealed on three sides. With the different fabric compositions, areal densities, thicknesses, and backing coating compositions listed in Table 1.

TABLE 1

| Pouch composition | | | | | |
|---|---|---|---|---|---|
| Pouch | Yarn Denier | Weave | Back Coating | Areal Density (g/m2) | Thickness (mm) |
| Nylon Pouch I | 70 d | ripstop | polyurethane | 130 | 0.15 |
| Nylon Pouch II | 200 d | plain | polyurethane | 200 | 0.23 |
| Nylon Pouch III | 70 d | ripstop | acrylic | 75 | 0.11 |
| Nylon Pouch IV | 50 0d | plain | acrylic | 241 | 0.37 |

Textile Layer Materials

"A" Layer

A KEVLAR® fabric JPS STYLE 767® available from JPS Composite Materials located in Anderson, S.C., was obtained. The Kevlar fabric was comprised of KEVLAR KM2+ 600 denier warp and fill yarns woven together in a plain weave construction with 28 ends/inch and 28 picks/inch. The fabric layer weighed 150 gsm after scouring to remove any yarn finishes present. A spike resistant layer was prepared by coating the KEVLAR® fabric in an aqueous bath comprising:

a) approximately 20% CAB-O-SPERSE PG003®, a fumed alumina dispersion (40% solids) with 150 nm particle size available from Cabot Corporation, and b) 2% MILLITEX RESIN MRX®, a blocked isocyanate based cross-linking agent (35-45% by wt. solids) available from Milliken Chemical.

The solution was applied using a padding process (dip and squeeze at a roll pressure of 40 psi). The fabric was then dried at 320° F. The dry weight add-on of the chemical on the fabric was approximately 2%. The coated fabric layer will be designated as the "A" layer in the following examples.

"B" Layer

A KEVLAR® fabric JPS STYLE 312® available from JPS Composite Materials located in Anderson, S.C., was obtained. The Kevlar fabric was comprised of KEVLAR KM2+ 400 denier warp and fill yarns woven together in a plain weave construction with 36 ends/inch and 36 picks/inch. The fabric layer weighed 120 gsm after scouring to remove any yarn finishes present. A spike resistant layer was prepared by coating the KEVLAR® fabric in an aqueous bath comprising:

a) approximately 20% CAB-O-SPERSE PG003®, a fumed alumina dispersion (40% solids) with 150 nm particle size available from Cabot Corporation, and b) 2% MILLITEX RESIN MRX®, a blocked isocyanate based cross-linking agent (35-45% by wt. solids) available from Milliken Chemical.

The solution was applied using a padding process (dip and squeeze at a roll pressure of 40 psi). The fabric was then dried at 320° F. The dry weight add-on of the chemical on the fabric was approximately 3%. The coated fabric layer will be designated as the "B" layer in the following examples.

"C" Layer

A KEVLAR® fabric JPS STYLE 312® available from JPS Composite Materials located in Anderson, S.C., was obtained. The Kevlar fabric was comprised of KEVLAR KM2+ 400 denier warp and fill yarns woven together in a plain weave construction with 36 ends/inch and 36 picks/inch. The fabric layer weighed 120 gsm after scouring to remove any yarn finishes present. The fabric layer will be designated as the "C" layer in the following examples.

Slip Layer Materials

Polyethylene Film

A blown film of black low density polyethylene ("PE") film was obtained at 25 micrometer thickness with an areal density of 24 grams per square meter (gsm).

Polypropylene Film

A polypropylene film ("PP") was made at 50 micrometer thickness as a blown film from PROFAX® SR257m resin available from Lyondell Basell based in Houston, Tex. The film had an areal density of 47 gsm

EXAMPLES

For each of the examples, the summary for the orientation of the Examples are shown in Table 1. The pouch compositions for the Examples are shown in Table 2. The assembly was tested for spike stab resistance. The results of the spike testing are shown in Table 3.

Example 1

Example 1 was formed from arranging the following layers in order: 6 "B" layers and 9 "A" layers with the grouping of "B" layers oriented as the strike face surface. The layers were encased in the nylon pouch Ito form the package. The example had an areal density of 2.12 kg/m$^2$ excluding the pouch weight.

Example 2

Example 2 was formed from arranging the following layers in order: 6 "B" layers and 9 "A" layers with the grouping of "B" layers oriented as the strike face surface. The layers were tested without the use of a nylon pouch. The example had an areal density of 2.12 kg/m$^2$.

Example 3

Example 3 was formed from arranging the following layers in order: 6 "B" layers and 9 "A" layers with the grouping of "B" layers oriented as the strike face surface. The layers were encased in the nylon pouch with the PE film (slip layer) placed between the "A" layers and the nylon pouch I. The example had an areal density of 2.12 kg/m$^2$ excluding the pouch weight.

Example 4

Example 4 was formed from 12 "A" layers. The layers were encased in the nylon pouch I. The example had an areal density of 1.82 kg/m$^2$ excluding the pouch weight.

Example 5

Example 5 was formed from 12 "A" layers. The layers were encased in nylon pouch II for testing. The example had an areal density of 1.82 kg/m$^2$ excluding the pouch weight.

Example 6

Example 6 was formed from 12 "A" layers. The layers were encased in nylon pouch III for testing. The example had an areal density of 1.82 kg/m$^2$ excluding the pouch weight.

Example 7

Example 7 was formed from 12 "A" layers. The layers were encased in nylon pouch I for testing with the PP film placed opposite the strikeface between the "A" layers and the pouch. The example had an areal density of 1.87 kg/m$^2$ excluding the pouch weight.

Discussion of Results

Table 2 shows the static COF between various layers and materials within the package. Table 3 shows the testing results of the examples.

TABLE 2

Coefficient of Friction Results - ASTM D1894

| Sled | Ramp | Static COF | Dynamic COF |
|---|---|---|---|
| A layer | Pouch I | 0.64 | 0.62 |
| A layer | Pouch IV | 0.64 | 0.50 |
| B layer | B layer | 0.44 | 0.32 |
| A layer | A layer | 0.42 | 0.32 |
| A layer | B layer | 0.41 | 0.30 |
| A layer | PE Film | 0.38 | 0.32 |
| A layer | Pouch III | 0.37 | 0.30 |
| C layer | C layer | 0.35 | 0.25 |
| A layer | PP Film | 0.31 | 0.28 |
| A layer | Pouch II | 0.27 | 0.25 |

TABLE 3

Results from NIJ 0115.00 Spike level 3, energy level 2 for Examples

| Example | Pouch | Slip Layer | % passing | # drops |
|---|---|---|---|---|
| 1 | I | none | 0 | 2 |
| 2 | none | none | 100 | 3 |
| 3 | I | PE | 100 | 5 |
| 4 | I | none | 50 | 6 |
| 5 | II | none | 100 | 3 |
| 6 | III | none | 100 | 3 |
| 7 | I | PP | 100 | 4 |

Examples 3 and 7 embody the invention wherein the panel contains at least one slip layer. Examples 1 and 4-6 represent common practice in stab vests wherein the stab resistant layers are encased directly in a water resistant pouch.

As one can see from comparing Examples 1 and 3, having the lower COF by incorporating the slip plane greatly improves the passing results against NIJ 0115.00 spike Level 3 E2. The same results can be seen by comparing Examples 4 and 7 using a different slip layer. Additionally, Example 2 shows that by removing the pouch altogether, spike resistance is improved. As described earlier, the pouch serves to protect the spike layers but when it restricts the movement of the layers in response to a stab threat, the pouch can reduce the ability of the spike layers to resist penetration. The slip layer allows the spike layers move in response to the threat even when the layers are encased in a pouch.

Examples 5 and 6 show that replacing a high COF pouch with a much lower COF pouch creates a similar effect by reducing slip resistance and improving spike resistance.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A spike resistant package comprising:

a pouch having an inner surface and an outer surface;

a first grouping of spike resistant textile layers, wherein each spike resistant textile layer comprises an upper and lower surface, wherein the grouping has a first side, a second side, and comprises plurality of spike resistant textile layers, wherein each of the spike resistant textile layers comprise a plurality of interwoven yarns or fibers having a tenacity of about 5 or more grams per denier, wherein at least a portion of the spike resistant textile layers comprise about 10 wt. % or less, based on the total weight of the spike resistant textile layer, of a coating comprising a plurality of particles having a diameter of about 20 μm or less on at least one of the upper or lower surfaces of the spike resistant textile layer; and, a slip layer, wherein the slip layer has a thickness of less than about 0.1 mm, a stiffness of less than about 0.01 N-m, and a static coefficient of friction (COF) between the slip layer and the second side of the first grouping of less than about 0.40, wherein the slip layer is located on the second side of the grouping of spike resistant textile layers, wherein the pouch essentially fully encapsulates the grouping of spike resistant textile layers and the slip layer, and wherein the slip layer and the inner surface of the pouch are in direct and intimate contact.

2. The spike resistant package of claim 1, wherein the pouch comprises a pouch textile.

3. The spike resistant package of claim 1, wherein the static COF between the slip layer and the inner surface of the pouch is less than about 0.40.

4. The spike resistant package of claim 1, wherein the grouping of spike resistant textile layers comprises at least 4 spike resistant textile layers.

5. The spike resistant package of claim 1, wherein the spike resistant textile layers are woven textile layers comprising a plurality of warp yarns and weft yarns.

6. The spike resistant package of claim 5, wherein spike resistant textile layers of the first grouping have a weave density of between about 20 and 45 warp yarns per inch and between about 20 and 45 weft yarns per inch.

7. The spike resistant package of claim 5, wherein the package further comprises a second grouping of spike resistant textile layers within the pouch, wherein the second grouping is located on the first side of the first grouping, and wherein the spike resistant textile layers of the second grouping are woven textile layers.

8. The spike resistant package of claim 6, wherein the woven textile layers of the second grouping have a tighter weave than the woven textile layers of the first grouping.

9. The spike resistant package of claim 1, wherein the particles are selected from the group consisting of silica, alumina, silicon carbide, titanium carbide, tungsten carbide, titanium nitride, silicon nitride, and combinations thereof.

10. The spike resistant package of claim 1, wherein the particles have a diameter of about 300 nm or less.

11. The spike resistant package of claim 1, wherein the yarns or fibers of the spike resistant textile layers comprise fibers selected from the group consisting of gel-spun ultra-high molecular weight polyethylene fibers, melt-spun polyethylene fibers, melt-spun nylon fibers, melt-spun polyester fibers, sintered polyethylene fibers, aramid fibers, PBO fibers, PBZT fibers, PIPD fibers, poly(6-hydroxy-2-napthoic acid-co-4-hydroxybenzoic acid) fibers, carbon fibers, and combinations thereof.

12. The spike resistant package of claim 1, wherein the yarns or fibers of the spike resistant textile layers have a tenacity of about 14 or more grams per denier.

13. The spike resistant package of claim 1, further comprising additional slip layers.

* * * * *